US005549499A

United States Patent [19]

Foskey et al.

[11] Patent Number: 5,549,499

[45] Date of Patent: Aug. 27, 1996

[54] ADJUSTABLE DOLL STAND

[76] Inventors: Jere N. Foskey; Jean C. Foskey, both of 440 Bucklen St., Swainsboro, Ga. 30401

[21] Appl. No.: 436,887

[22] Filed: May 8, 1995

Related U.S. Application Data

[63] Continuation-in-part of Ser. No. 95,509, Jul. 23, 1993, abandoned.

[51] Int. Cl.[6] ..... A63H 3/50

[52] U.S. Cl. ..... 446/268; 248/405

[58] Field of Search ..... 248/405, 406.1, 248/121, 125, 188.5, 131, 176, 295.1, 414; 446/489, 268; 40/369, 601; 482/17

[56] References Cited

U.S. PATENT DOCUMENTS

| | | | |
|---|---|---|---|
| 252,401 | 1/1882 | Stauffer | 248/405 |
| D. 287,386 | 12/1986 | Kaiser . | |
| 352,161 | 11/1886 | Staples . | |
| 740,619 | 10/1903 | Bolens | 248/406.1 |
| 911,893 | 2/1909 | Massey | 248/405 |
| 1,105,519 | 7/1914 | Jessup . | |
| 2,919,877 | 1/1960 | Gallagher . | |
| 3,313,505 | 4/1967 | Petrie | 248/405 |
| 3,771,753 | 11/1973 | Wilbur . | |
| 4,018,217 | 4/1977 | Evans | 248/405 |
| 4,706,915 | 11/1987 | Cindric et al. | 248/122 |

*Primary Examiner*—Robert A. Hafer
*Assistant Examiner*—Jeffrey D. Carlson
*Attorney, Agent, or Firm*—Rodgers & Rodgers

[57] ABSTRACT

An adjustable doll stand is provided with a threaded rod telescopically disposed in a hollow tube and with the rod and tube upstanding from a base element. Doll clamping arms are secured to the rod and can be raised or lowered by rotation of a ring threaded onto the rod. A detent formed in the hollow tube cooperates with a flat surface disposed on the rod to prevent rotation of the clamping arms.

5 Claims, 2 Drawing Sheets

ADJUSTABLE DOLL STAND

This is a continuation-in-part of application Ser. No. 08/095,509 filed Jul. 23, 1993, now abandoned.

BACKGROUND OF THE INVENTION

Over the years, the display of dolls has become quite multifaceted. Dolls are often displayed for personal enjoyment as well as professionally in a wide variety of activities such as doll shows, exhibitions and competitions. Besides their utilization in the display of dolls, doll stands are also necessary for conveniently grooming the doll's hair and adjusting its costume.

Known doll stands generally are of the clamp variety wherein a stand of a particular height is provided with clamping means which fits around the doll's waist or under its arms. Another type stand is the so-called saddle type wherein the doll in effect sits on the stand. Both of these types stands are generally produced in a varying number of specific sizes wherein a doll stand of a particular height is only compatible with a doll of corresponding height requirements.

SUMMARY OF THE INVENTION

According to this invention, an adjustable doll stand is provided with a base and a hollow tube upstanding therefrom. A rod is telescopically disposed in the hollow tube and is provided with doll clamping means secured thereto. A ring is interconnected with the rod so that rotation of the ring causes the clamping means to be raised or lowered and means is provided to prevent rotation of the clamping means relative to the hollow tube..

DESCRIPTION OF THE PREFERRED EMBODIMENTS

Figure 1:
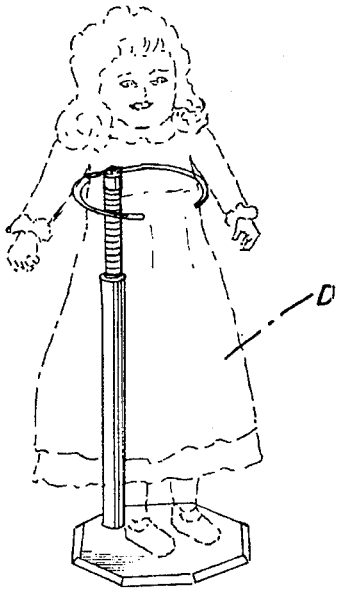
FIG. 1 is a perspective view of an adjustable doll stand according to this invention with a doll shown in phantom lines.
Figure 5:
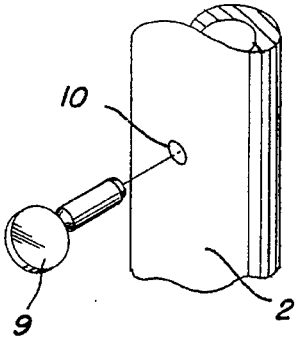
FIG. 5 is an enlarged fragmentary view showing alternative rotation prevention means.

In the drawings, the numeral 1 designates the base element of the doll stand with hollow tube 2 secured thereto and upstanding therefrom. Threaded rod 3 is coaxially disposed with respect to hollow tube 2 and telescopically interrelated therewith.

For the purpose of holding the displayed doll, doll clamping means is provided in the form of arms 4 and 5 which comprise the horizontally disposed ends of a unitary wire which is bent in the middle and secured to the upper portion of threaded rod 3. In order to protect the doll from any inadvertent damage, arms 4 and 5 may be, if desired, coated with vinyl.

Figure 2:
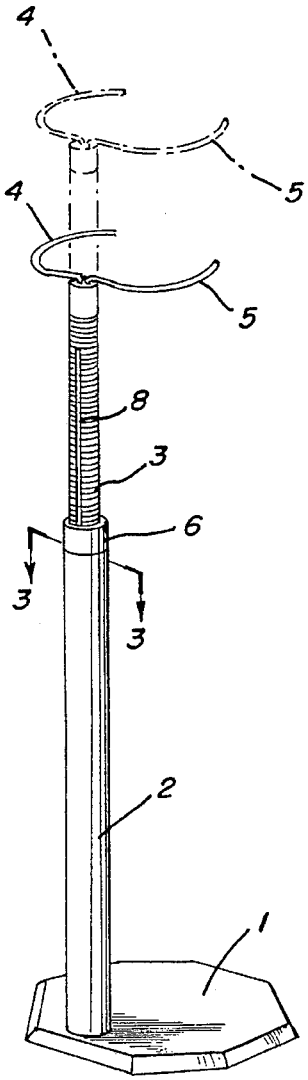
FIG. 2 is an enlarged perspective view of the adjustable doll stand with the doll clamping means in the upper position shown in phantom lines.
Figure 3:
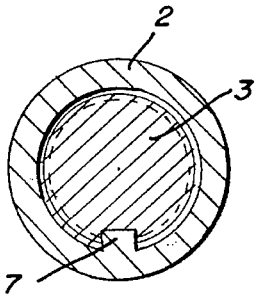
FIG. 3 is a cross sectional view taken along the line 3—3 in FIG. 2.
Figure 4:
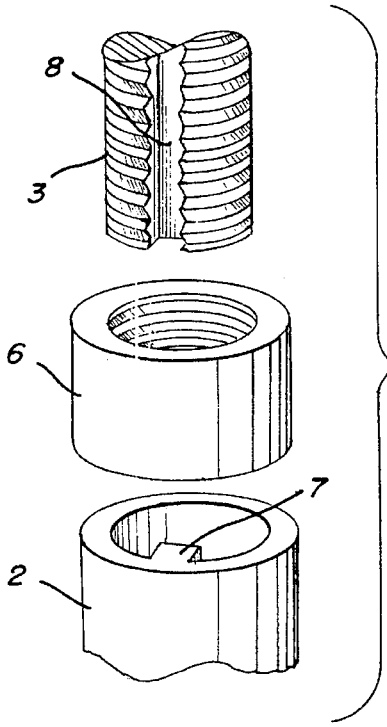
FIG. 4 is an enlarged exploded view of the doll stand adjustability means.

In order to provide an ability to adjust the height of arms 4 and 5, interiorly threaded ring 6 is provided with the lower surface thereof being disposed in face contacting relation with the upper surface of hollow tube 2, as best shown in FIG. 2. Further, ring 6 is threadedly interrelated with respect to rod 3 whereby rotation of ring 6 in one direction causes rod 3 and associated arms 4 and 5 to be raised and wherein rotation of ring 6 in the opposite direction causes rod 3 and associated arms 4 and 5 to be lowered.

In order to prevent rotation of displayed doll D, a key and slot arrangement is provided in the form of key 7 which is integrally formed on the interior surface of hollow tube 2 and which is adapted for sliding engagement in slot 8 formed on the surface of rod 3. Therefore, as rod 3 is adjusted upwardly and downwardly, rotation of arms 4 and 5 is prevented throughout the entire vertical travel of rod 3 since key 7 is disposed in slot 8 thereby interlocking rod 3 with respect to tube 2. Alternatively, rotation of doll D is prevented by means of pin 9 which is inserted into aperture 10, formed in hollow tube 2, a sufficient distance to enter slot 8. Of course, the adjustable doll stand according to this invention may be manufactured of various suitable materials such as plastic, pecan resin, metal or other solid surface material.

It is well known that dolls come in a multitude of heights and circumferences. Therefore, when it is desired to display a doll according to this invention, it is first determined whether the doll clamping means is to be affixed to the waist portion of the doll or under its arms. If it is desired to display a doll by affixing the doll clamping means under the dolls arms, for example such as shown in FIG. 1, the doll is placed adjacent the doll stand and ring 6 is simply rotated in such direction as necessary to cause arms 4 and 5 to be raised or lowered to the desired level. Thereafter, arms 4 and 5 are simply manually opened and placed around the doll. Of course, arms 4 and 5 can be adjusted in a horizontal plane in order to adapt to the circumference requirements of the doll being displayed.

Although the doll clamping means as shown in the drawing is in the form of arms 4 and 5, other suitable clamping means can be utilized in conjunction with this invention. For example, doll clamping means can be in the form of a saddle arrangement whereby the doll in effect sits on a two prong arrangement wherein the one prong extends upwardly in front of the doll and the other prong stands upwardly behind the doll and wherein the two prongs form a clamped relationship therewith.

Figure 6:
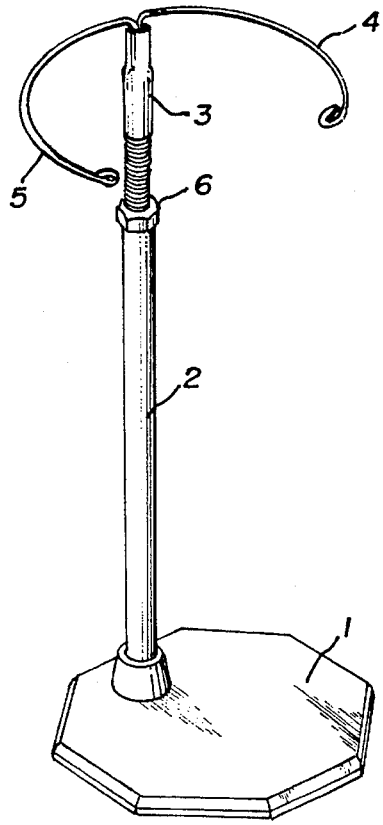
FIG. 6 is a perspective view of a modified form of the invention.
Figure 7:
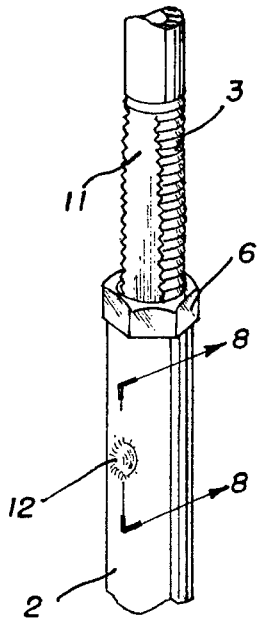
FIG. 7 is an enlarged perspective view of a portion of the stand shown in FIG. 6.
Figure 8:
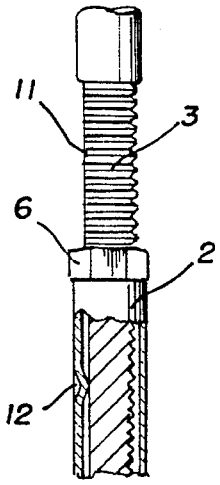
FIG. 8 is an elevational view taken along the line 8—8 in FIG. 7.

A modified form of this invention is shown in FIGS. 6, 7 and 8 in connection with which flat surface 11 is formed on a portion of the periphery of threaded rod 3 and detent 12 is formed in hollow tube 2 as best shown in FIGS. 7 and 8. Therefore, as ring 6 is rotated threaded rod 3 is caused to be raised or lowered and, simultaneously with this operation, detent 12 slides along flat surface 11 thereby preventing rotation of arms 4 and 5 throughout the vertical travel of rod 3.

Therefore, as is apparent, by this invention, a doll stand is provided by which the displayed doll is prevented from rotation but is adjustable to comport to dolls of varying height requirements. Also, the doll stand can be easily adapted for use in connection with clamping means generally disposed in a horizontal disposition as well as clamping means disposed generally vertically.

What is claimed is:

1. A doll stand comprising a base element, a hollow tube upstanding therefrom, said hollow tube having an outer diameter, a threaded rod telescopically disposed in said hollow tube, doll clamping means secured to said rod, a ring coaxially disposed with respect to said hollow tube and threadedly interconnected with said rod, said ring having the same outer diameter as said hollow tube, the bottom surface of said ring being disposed in flat face contacting relation with the upper surface of said hollow tube, said ring being seated flush with said hollow tube, a detent integrally formed on the inner surface of said hollow tube, a flat surface disposed on a portion of the periphery of said rod, said flat surface being coincidental with an imaginary plane extending between two points spaced horizontally on the circumference of said rod, and said detent being slidably engageable with said flat surface to prevent rotation of said doll clamping means.

2. A doll stand according to claim 1 wherein said doll clamping means comprises a unitary wire secured to said rod.

3. A doll stand according to claim 2 wherein a pair of horizontally disposed arms are formed respectively on the ends of said unitary wire.

4. A doll stand according to claim 1 wherein said base element and said hollow tube are manufactured of pecan resin.

5. A doll stand according to claim 1 wherein said base element and said hollow tube are manufactured of metal.

* * * * *